US008943636B2

(12) United States Patent
Yamaguchi et al.

(10) Patent No.: US 8,943,636 B2
(45) Date of Patent: Feb. 3, 2015

(54) ERASING DEVICE

(75) Inventors: Yoichi Yamaguchi, Shizuoka-ken (JP); Ken Iguchi, Shizuoka-ken (JP); Isao Yahata, Shizuoka-ken (JP); Takahiro Kawaguchi, Shizuoka-ken (JP); Yoshiaki Sugizaki, Shizuoka-ken (JP); Kikuo Mizutani, Shizuoka-ken (JP); Hiroyuki Taki, Shizuoka-ken (JP); Hiroyuki Tsuchihashi, Shizuoka-ken (JP); Chiaki Iizuka, Shizuoka-ken (JP); Hidetoshi Yokochi, Shizuoka-ken (JP); Toshiaki Oshiro, Shizuoka-ken (JP); Hiroyuki Hazu, Shizuoka-ken (JP); Hiroyuki Sugiyama, Shizuoka-ken (JP); Yuichi Saito, Shizuoka-ken (JP); Jun Ishii, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 224 days.

(21) Appl. No.: 13/603,044

(22) Filed: Sep. 4, 2012

(65) Prior Publication Data

US 2013/0061409 A1 Mar. 14, 2013

Related U.S. Application Data

(60) Provisional application No. 61/533,163, filed on Sep. 9, 2011.

(51) Int. Cl.
*B08B 1/02* (2006.01)
*B41J 2/32* (2006.01)

(52) U.S. Cl.
CPC ..... *B41J 2/32* (2013.01); *B41J 2202/37* (2013.01)
USPC ..... 15/77; 15/88.2

(58) Field of Classification Search
USPC ..... 15/77, 88.2
See application file for complete search history.

(56) References Cited

FOREIGN PATENT DOCUMENTS

| | | |
|---|---|---|
| JP | H08-63058 | 3/1996 |
| JP | 09-048547 | 2/1997 |
| JP | 2008-254928 | 10/2008 |
| JP | 2009-249132 | 10/2009 |

OTHER PUBLICATIONS

Computer translation of JP2008254928A.*
English Translation of Office Action dated Apr. 1, 2014, issued in corresponding Japanese Patent Application No. 2012-196250.

* cited by examiner

*Primary Examiner* — Shay Karls
(74) *Attorney, Agent, or Firm* — Patterson & Sheridan LLP.

(57) ABSTRACT

An erasing device of one embodiment includes a conveyance unit that conveys a sheet; a pair of rotating brushes is provided corresponding to both side portions in a width direction perpendicular to a sheet conveyance direction of the sheet conveyed by the conveyance unit, the rotating brushes being provided to oppose to each other, nipping the conveyed sheet, the rotating brushes rotating in the same direction as the sheet conveyance direction such that a circumferential speed of the brush tip has a higher speed than a conveyance speed of the sheet, the rotating brushes rolling and correcting a corner fold portion which occurs on the sheet conveyed by the brush tip portion while rotating; and an erasing unit is provided downstream in the sheet conveyance direction than the rotating brush, the erasing unit erasing an image which is formed on the sheet.

9 Claims, 9 Drawing Sheets

ERASING DEVICE

CROSS-REFERENCE TO RELATED APPLICATION

This application is based upon and claims the benefit of priority from: U.S. provisional application 61/533,163, filed on Sep. 9, 2011; the entire contents of which are incorporated herein by reference.

FIELD

Embodiments described herein relate to a technology which corrects a corner fold of a sheet conveyed for erasing such as decolorizing.

BACKGROUND

An erasing device which erasing the color of an image on a sheet is provided. The sheet subjected to erasing by the erasing device is reused through repeating image forming using a color material which has erasability and image erasing on the sheet.

As for the reused sheets, corner fold sheets in which the corner of the paper edge is folded over of the sheet may be mixed in among the sheets loaded on a paper feeding unit of the erasing device. Such corner folding of the sheet, for example, may occur when repeated process of erasing causes curling at the paper edge, and when the sheet is loaded on the paper feeding unit of the erasing device, the corner of the curled paper edge may become folded.

The corner fold may hinder normal conveyance of the sheet and further preclude sufficient decolorizing for an image on the paper surface covered by the corner fold portion.

DETAILED DESCRIPTION

An erasing device according to one embodiment includes a conveyance, unit that conveys a sheet; a pair of rotating brushes is provided corresponding to both side portions in a width direction perpendicular to a sheet conveyance direction of the sheet conveyed by the conveyance unit, the rotating brushes being provided to oppose to each other, nipping the conveyed sheet, the rotating brushes rotating in the same direction as the sheet conveyance direction such that a circumferential speed of the brush tip has a higher speed than a conveyance speed of the sheet, the rotating brushes rolling and correcting a corner fold portion which occurs on the sheet conveyed by the brush tip portion while rotating, and an erasing unit is provided downstream in the sheet conveyance direction than the rotating brush, the erasing unit erasing an image which is formed on the sheet.

Hereinafter, an erasing device according to one embodiment is described in detail with reference to the drawings.

First Embodiment

Figure 1:
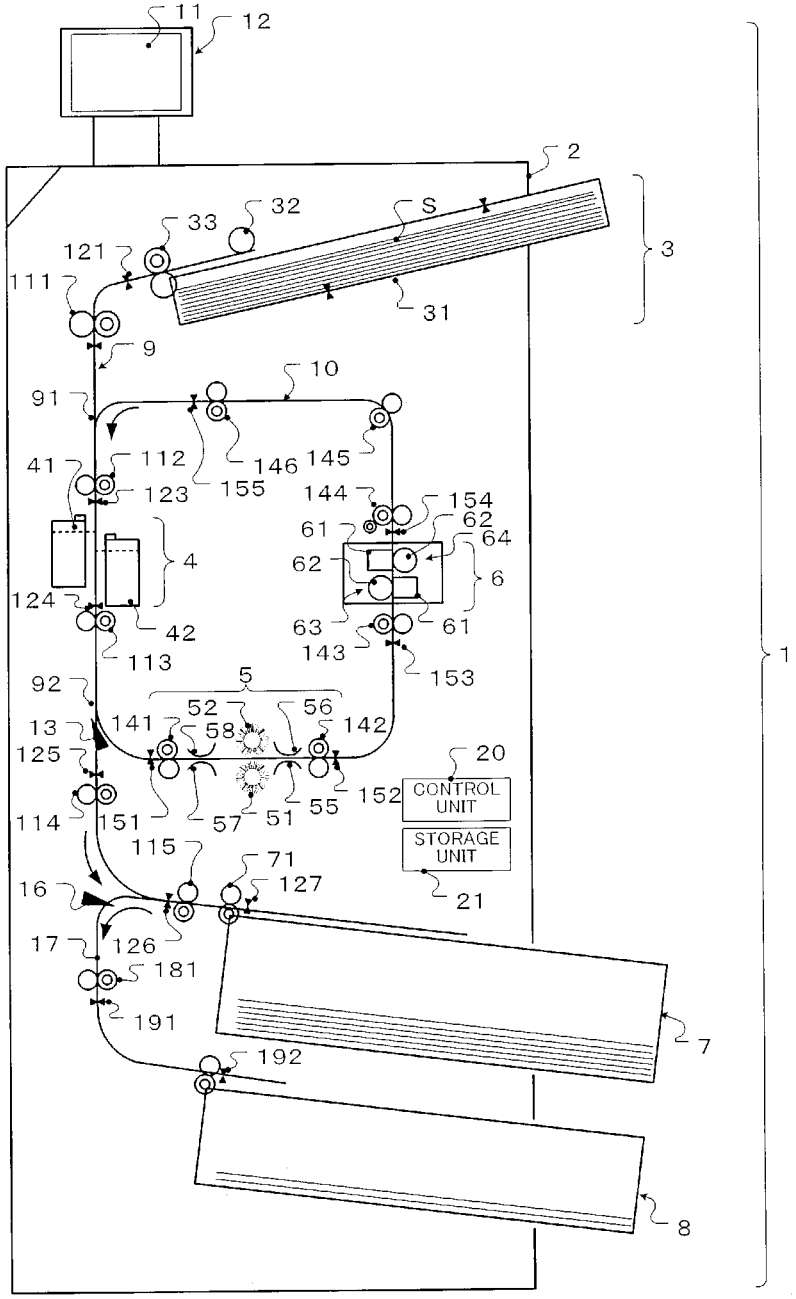
FIG. 1 is a diagram illustrating an overall configuration of an decolorizing device as an erasing device according to one embodiment.
Figure 2:
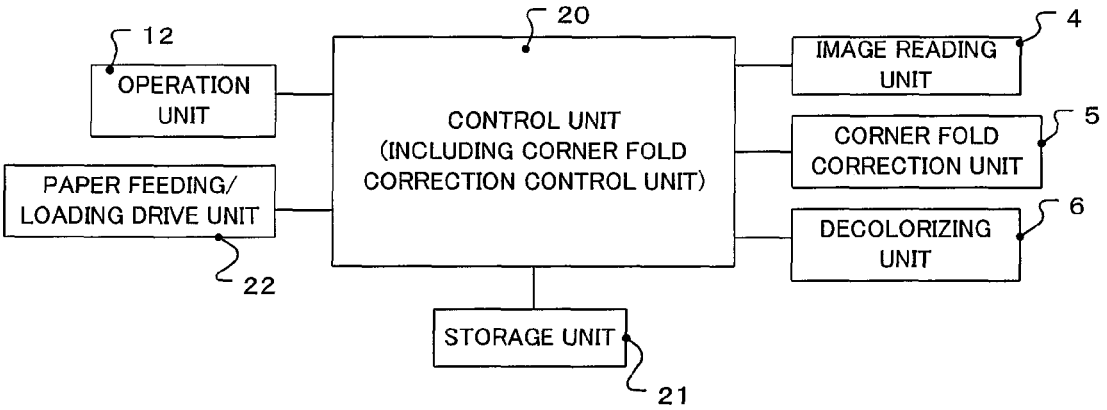
FIG. 2 is a control block diagram illustrating an overall configuration of an decolorizing device in FIG. 1.

FIG. 1 is a schematic side cross-sectional view illustrating an overall configuration of decolorizing device as an erasing device and FIG. 2 is a control block diagram illustrating one embodiment of a control device which controls an overall operation of an decolorizing device in FIG. 1.

Referring to FIG. 1, an decolorizing device 1, inside a device main body 2, includes a paper feeding unit 3 that feeds a plurality of sheets S subject to a thermal decolorizing process as an erasing process, an image reading unit 4, a corner fold correction unit 5, an decolorizing unit 6 that performs the thermal decolorizing process as the erasing process, a first loading tray 7 that serves as a sheet loading unit, a second loading tray 8 that serves as the sheet loading unit, a first conveyance route 9 and a second conveyance route 10. In addition, outside the device main body 2, an operation unit 12 which has a display screen 11 is provided.

The paper feeding unit 3 includes a stacker tray 31 that loads a plurality of sheets S subject to decolorizing, a pickup roller 32 and a paper feeding roller 33. In addition, the paper feeding unit 3 may load various sizes of sheet, for example A4, A5, Letter size, and the like. An image using a color material capable of decolorizing, for example, using an image forming device of an electrographic or inkjet type, is formed on the sheet.

Sheets S which are loaded on the stacker tray 31 are taken out one by one by the pickup roller 32 and fed to the first conveyance route 9 by the paper feeding roller 33. A conveyance terminal of the first conveyance route 9 continues to a conveyance roller 71 of the first loading tray 7. The first conveyance route 9 has conveyance rollers 111 to 115 for conveying the sheet S and sheet detecting sensors 121 to 127 which detect the sheet S. The sheet detecting information of the sheet detecting sensors 121 to 127 is sent to a control unit 20 and the control unit 20 drives and controls a conveyance motor which drives the conveyance rollers 111 to 115.

In the middle of the first conveyance route 9, from the upstream side to the downstream side of the conveyance, a merging unit 91 and a dividing unit 92 are provided. The merging unit 91 is connected to the conveyance terminal of the second conveyance route 10 and the dividing unit 92 is connected to a conveyance starting end of the second conveyance route 10. The image reading unit 4 is provided between the merging unit 91 and dividing unit 92 of the first conveyance route 9. The dividing unit 92 has a first flapper 13 to switch a conveyance direction of the sheets S which are conveyed on the first conveyance route 9 to any of the first loading tray 7 and the second conveyance route 10.

The second conveyance route 7 has the corner fold correction unit 5 and the decolorizing unit 6. In addition, on the second conveyance route 7, conveyance rollers 141 to 146 for conveying the sheet S and sheet detecting sensors 151 to 155 which detect the sheet S are provided. The sheet detecting information of the sheet detecting sensors 151 to 155 is sent to the control unit 20. In addition, the control unit 20 drives and controls a conveyance motor which drives the conveyance rollers 141 to 146. In one embodiment, the corner fold correction unit 5 is provided on the second conveyance route 10, but may be provided on the first conveyance route 9.

The conveyance route of the sheet S fed to the first conveyance route 9 from the stacker tray 31 may be appropriately changed, based on a processing mode performed by the decolorizing device 1. The decolorizing device 1 has a plurality of processing modes. The decolorizing device 1, for example, includes (1) a first decolorizing mode which performs only the decolorizing without performing the image reading, (2) a second decolorizing mode which performs the decolorizing after reading the image, (3) a third decolorizing mode which performs identification (identifying) of whether or not the sheet S is reusable, after decolorizing, without reading prior to decolorizing, (4) a fourth decolorizing mode which performs the decolorizing after reading the image and further performs the identifying, (5) a reading mode which performs the image reading without the image decolorizing, and (6) a corner fold correction mode where besides the above-described respective modes (1) to (5), correcting by the corner fold correction unit 5 which corrects the corner fold of the sheet is additionally included. The above-described respective modes may be selected by the operation unit 12 of the decolorizing device 1. In addition, selections of the respective modes may be also set by an outer terminal without limiting to the operation unit 12 of the decolorizing device 1. In the corner fold correction mode, the sheet S is necessarily conveyed to the decolorizing unit 6. In addition, the corner fold correction unit 5 will be described later.

The image reading unit 4 has a first scanner unit 41 and a second scanner unit 42 being provided so as to oppose to each other with nipping the sheet conveyed on the first conveyance route 9 therebetween, and reads the image formed on the sheet S including an outline of the sheet S. The image reading unit 4 reads a first surface of the sheet S using the first scanner unit 41 and reads a second surface using the second scanner unit 42. The read image information is sent to the control unit 20 and a storage unit 21. The image information read by the image reading unit 4 prior to the decolorizing is stored at the storage unit 21. Thus, image data prior to the decolorizing, even though achromatized by the decolorizing unit 6, may be called.

In one embodiment, a case where the decolorizing unit 6 achromatizes the achromatized image formed on both surfaces of the sheet by heating at greater than a predetermined decolorizing temperature is exemplified.

The decolorizing unit 6 is configured so that, at both sides of a sheet conveyance surface, a first heating unit 63 where a heating body 61 is provided opposing a pressurizing roller 62 which is in pressurizing contact with the heating body 61 and a second heating unit 64 which has the same configuration as the first heating unit 63 and where the heating body 61 is provided contrary to the pressurizing roller 62 are provided in series along the sheet conveyance direction.

If the sheet S is fed to a nipping unit of the first heating unit 63, the image formed on the first surface of the sheet S is achromatized. If the sheet S is fed to a nipping unit of the second heating unit 64, the image formed on the second surface of the sheet S is achromatized. In addition, a case where both surfaces of the sheet are achromatized at one time is exemplified, but only one side may also be achromatized.

The achromatized sheet S which passes through the decolorizing unit 6 is conveyed on the second conveyance route 10, merges on the first conveyance route 9 at the merging unit 91 and both sides thereof are read again by the image reading unit 4. At that time, the outline of the sheet is also read.

As for the sheet S passing through the decolorizing unit 6, at the image reading unit 4, the first surface and the second surface of the sheet S which are achromatized are read by the first scanner 41 and the second scanner 42 and the re-read information is sent to the control unit 20. The control unit 20, based on the re-read information, determines whether or not to achromatize and whether or not the corner fold correction is suitable. In addition, the determination on whether or not the corner fold correction is suitable will be described later.

Determining the decolorizing to be suitable may be exemplified by a case where after sufficiently decolorizing by the decolorizing unit 6, a remnant of the image is no longer present, or even if present, the remnant is barely recognizable to a reusable extent. Determining the decolorizing to be negative may be exemplified by a case where the decolorizing is insufficient and the image which is the remnant of the decolorizing and subject to decolorizing is present to a recognizable extent. In addition, a case where a handwritten image in ink or the like which is non-erasable is present or a case where the image is formed by a color material which is non-erasable is included.

The sheet S which finishes the determination on whether or not the decolorizing is suitable is conveyed toward the dividing unit 92 on the first conveyance route 9. At that time, the first flapper 13 is withdrawn from the first conveyance route 9 and the sheet S, for which determination on whether or not the decolorizing is suitable is completed, is conveyed toward the first loading tray 7.

The first loading tray 7 and the second loading tray 8 are provided vertically in two stages at the lower portion of the device main body 2 of the decolorizing device 1. In addition, the first loading tray 7 and the second loading tray 8 are connected to each other on a third conveyance route 17 which has a second flapper 16 for switchback. The third conveyance route 17 has conveyance rollers 181 and 182 and additionally has sheet detecting sensors 191 and 192 which detect the sheet S. The sheet detecting information of the sheet detecting sensors 191 and 192 is sent to the control unit 20 and a drive motor which drives the conveyance rollers 181 and 182 is driven and controlled by the control unit 20.

The achromatized sheet S which is conveyed toward the first loading tray 7 waits for a moment at a conveyance end of the first conveyance route 9 and waits for the determination on whether or not the decolorizing is suitable. The reusable sheet S, for which decolorizing is determined to be suitable by the control unit 20, is conveyed as is and loaded on the first loading tray 7. On the other hand, if it is determined that the decolorizing is negative by the control unit 20, the second flapper 16 switches the third conveyance route 17 to the open direction, conveys the non-reusable sheet S, which waits at the terminal of the first conveyance route 9 and for which it is determined that the decolorizing is negative, toward the third conveyance route 17 and loads the sheets on the second loading tray 8.

Accordingly, on the sheet which is loaded on the first loading tray 7, the image capable of decolorizing by the color material which has the decolorizing characteristics may be formed again and on the same sheet, the image may be formed repeatedly by the color material which has the decolorizing characteristics.

The above description makes a condition of the reusable sheet S which is to be loaded on the first loading tray 7, and a requisite of the determination that the decolorizing is suitable. However, a requisite of the determination that the corner fold correction to be described later is suitable is added. Accordingly, even though the sheet S is suitably achromatized, if the corner fold correction is insufficient, the sheet is determined to be unusable and loaded on the second loading tray 8.

As illustrated in FIG. 2, the control unit (controller) of the decolorizing device 1 controls the overall decolorizing device and includes a corner fold correction control unit 301 to be described later. The control unit 20 has processors and memories which are formed from CPU (Central Processing Unit) or MPU (Micro Processing Unit). Referring to FIG. 2, a paper feeding and loading drive unit 22 includes a pickup roller 32 which performs the paper feeding and loading of the above-described sheet S, a paper feeding roller 33, conveyance rollers 71 and 182, the first flapper 13, the second flapper 16, drive motors which respectively drive a plurality of conveyance rollers, and a plurality of the sheet detecting sensors which detect the sheet, sends the detecting information to the control unit 20 and is driven according to a predetermined program. In addition, the image reading unit 4, the corner fold correction unit 5, the decolorizing unit 6 and the operation unit 12 also send information to the control unit 20 to be driven and controlled.

Memory is, for example, a semiconductor memory and includes ROM (Read Only Memory) which stores various control programs and RAM (Random Access Memory) which provides a temporary work region to the processor. For example, the ROM stores the printing rate of a paper which is a threshold value on whether the sheet is reusable or non-reusable and a density threshold value in order to determine whether an image is achromatized or not. The RAM may also temporarily store the image which is read by the image reading unit 4.

The storage unit 21 stores application programs and an OS The application programs include a program which performs a reading function using the image reading unit 4 and functions which the decolorizing device has, such as an decolorizing function of the decolorizing unit. The application programs further include applications for a web client (web browser) or the other applications. The storage unit 21 stores a treated number of the sheets which are treated by the decolorizing device 1 and an image which is read by the image reading unit 4. The storage unit 21, for example, may be hard disk drives, other magnetic storage devices, optical storage devices, semiconductor memory devices such as flash memories, or any arbitrary combination thereof.

Figure 3:
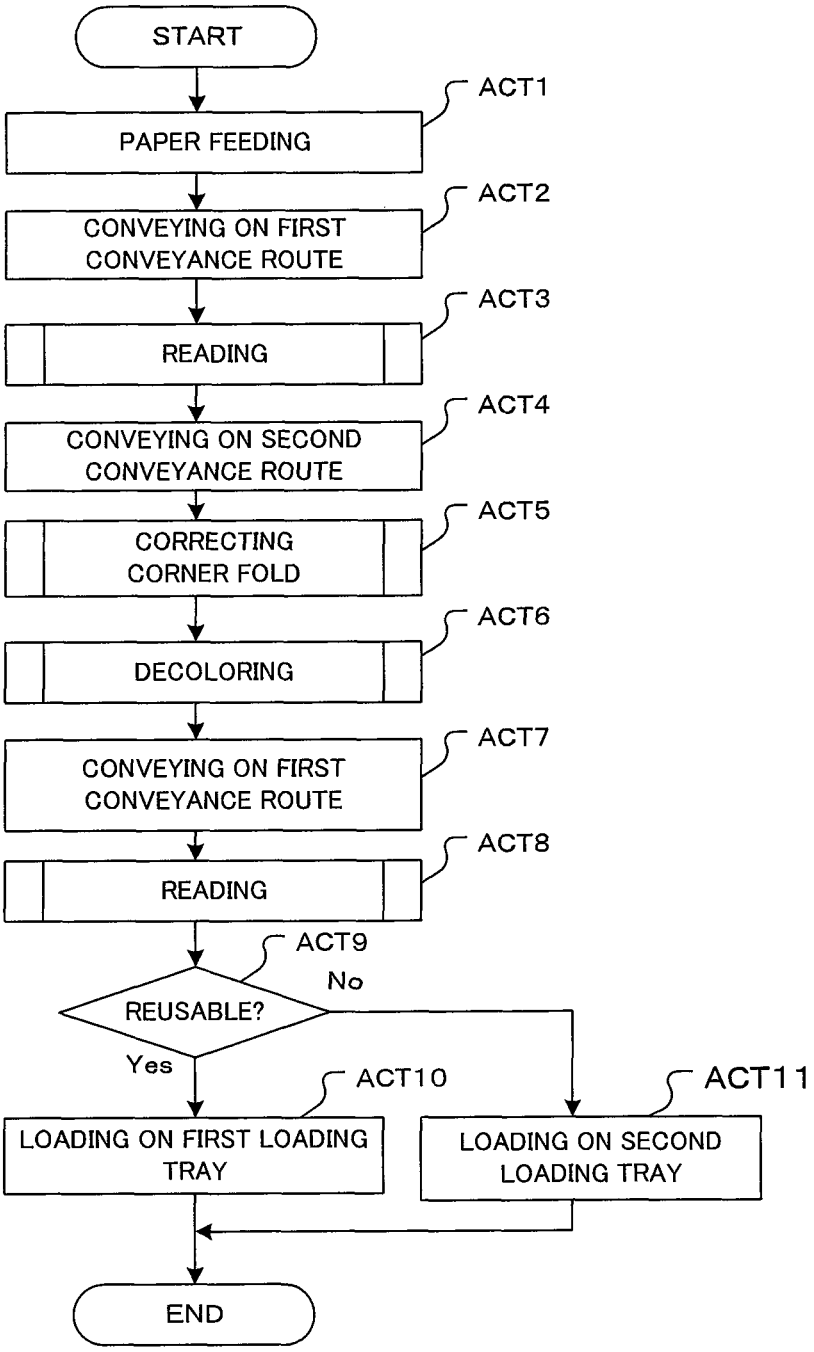
FIG. 3 is a flowchart illustrating a process flow by a control unit in FIG. 2.

FIG. 3 is a flowchart which illustrates a treatment operation of decolorizing suitability by the control unit 20 of the decolorizing device illustrated in FIG. 2.

In ACT 1, the sheet S is fed from the paper feeding unit 3 and the sheet S is conveyed to the first conveyance route 9 (ACT 2).

In ACT 3, images on the first surface and the second surface of the sheet S and the overall sheet S are read and based on the image information read, corner fold detecting of the sheet S is performed (ACT 3). In addition, the storage unit 21 stores the image information read.

In ACT 4, the sheet S which passes through the reading unit 4 is conveyed to the second conveyance route 10 and the corner fold correction is performed (ACT 5). Then, the decolorizing is performed (ACT 6).

The sheet S which finishes the corner fold correction and the decolorizing is again conveyed to the first conveyance route 9 (ACT 7) and the images on the first surface and the second surface of the sheet S and the overall surface of the sheet S are read again by the reading unit 4 (ACT 8).

In ACT 9, based on the image information read in ACT 8, reusability is determined (ACT 9). The sheet S which is determined to be reusable is conveyed and loaded on the first loading tray 7 and the sheet S which is determined to be non-reusable is conveyed and loaded on the second loading tray 8. The determination of the reusability includes the determination of decolorizing suitability and corner fold correction suitability.

Next, a configuration of the corner fold correction unit 5 is described below with reference to FIG. 4 to FIG. 9.

Figure 4A:
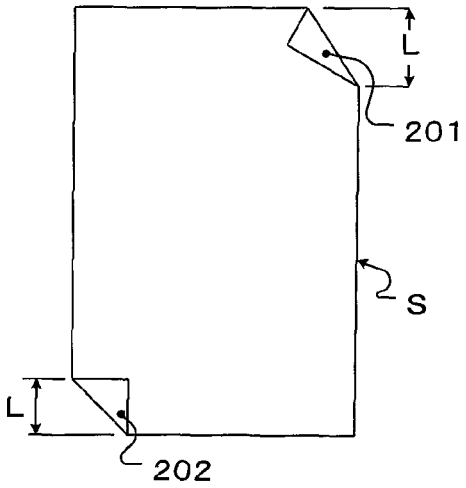
FIG. 4A and FIG. 4B are explanatory diagrams illustrating a corner fold portion which occurs on a sheet.
Figure 4B:
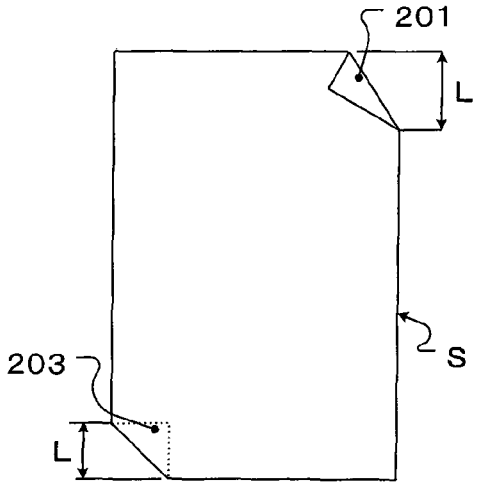

The corner fold of the sheet, as illustrated in FIG. 4A and FIG. 4B, means a phenomenon where a corner portion of the sheet S is folded over. As described before, for example, repeated decolorizing causes a curl at the paper edge and when loading the sheet on the paper feeding unit of the decolorizing device, the curled corner of the paper edge is folded over. FIG. 4A illustrates a state that corner fold portions 201 and 202 occur at one side of the sheet S and FIG. 4B illustrates a state where the corner fold portion 201 occurs at a front surface of the sheet S and a corner fold portion 203 occurs at the rear surface. FIG. 4A and FIG. 4B illustrate a case where the corner fold portions respectively occur at a leading edge and a trailing edge of the sheet S in the conveyance direction of the sheet S, but may also occur at only the leading edge or the trailing edge in the conveyance direction of the sheet S. In addition, the region of occurrence may also be both corners in the width direction of the sheet S or any side of the corner portions.

In one embodiment, the corner fold correction unit 5 which corrects the corner fold portion which occurs on the sheet S is provided further to the upstream side than the decolorizing unit 6 on the second conveyance route 10. The corner fold correction unit 5 include's a rotating brush 51 (hereinafter referred to as a first rotating brush) for a first surface opposing the first surface of the sheet S and a rotating brush 52 (hereinafter referred to as a second rotating brush) for a second surface opposing the second surface of the sheet S. In addition, FIG. 5 illustrates the second surface of the sheet S as a top surface and the first surface becomes a rear surface side.

The first rotating brush 51 and the second rotating brush 52 are provided between a conveyance roller 141 (hereinafter referred to as a first conveyance roller) and a conveyance roller 142 (hereinafter referred to as a second conveyance roller) illustrated in FIG. 1.

Figure 5:
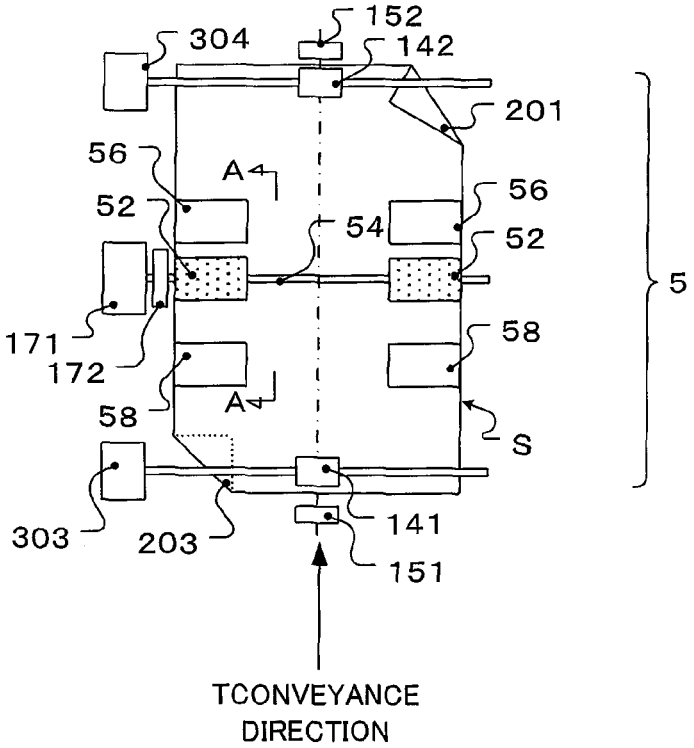
FIG. 5 is a top view of a corner fold correction unit illustrated in FIG. 1.
Figure 6:
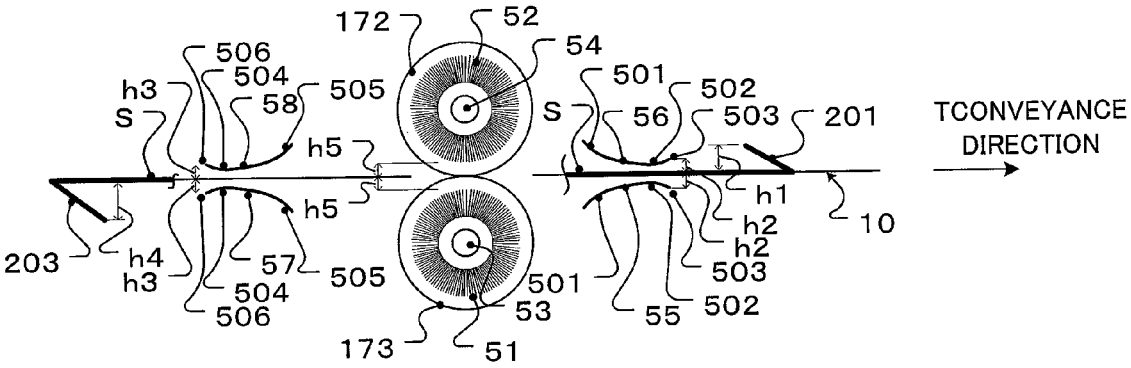
FIG. 6 is a perspective view taken along line A-A in FIG. 5.

As illustrated in FIG. 5 and FIG. 6, the first rotating brush 51 is fixed to a first drive shaft 53 which is provided along a direction (hereinafter referred to as a sheet width direction) perpendicular to the sheet conveyance direction. In one embodiment, two first rotating brushes 51 are fixed to both sides in the sheet width direction and by the rotation of the first drive shaft 53, the two first rotating brushes 51 are rotated.

The second rotating brush 52 is fixed to a second drive shaft 54 which is provided along the sheet width direction. In one embodiment, two second rotating brushes 52 are fixed to both sides in the sheet width direction and by the rotation of the second drive shaft 54, the two second rotating brushes 52 are rotated. Two of the first rotating brushes 51 and the second rotating brushes 52 are provided corresponding to both sides in the width direction of the sheet S. When corresponding to a sheet which has longer length in the width direction than the sheet S illustrated in FIG. 5, the length of the first rotating brush 51 and the second rotating brush 52 in the axial direction may be set to be long or a first rotating brush 51 and a second rotating brush 52 may be further added and provided corresponding to both sides in the width direction of the sheet.

The first rotating brush 51 and the second rotating brush 52 are driven and rotated in opposite directions to each other. Accordingly, with respect to the first surface and the second surface of the sheet S, the first rotating brush 51 and the second rotating brush 52 come to have the same direction in the brush touching direction.

As a drive mechanism of the first rotating brush 51 and the second rotating brush 52, a configuration that drives each using dedicated drive motors or a configuration that drives using one drive motor may be exemplified. In FIG. 5 and FIG. 6, a brush drive motor 171 drives the second drive shaft 54. By engaging a transmission gear 172 which is fixed to the second drive shaft 54 and a transmission gear 173 which is fixed to the first drive shaft 53, the first drive shaft 53 is rotated in the opposite direction to the second drive shaft 54.

At the downstream side in the sheet conveyance direction of the respective first rotating brushes 51 and the respective second rotating brushes 52, further to the upstream side than the second conveyance roller 142, a first correction body 55 that rolls and corrects the corner fold portion which occurs at the sheet leading edge of the first surface of the sheet S and a second correction body 56 that rolls and corrects the corner fold portion which occurs at the sheet leading edge of the second surface of the sheet S are respectively provided. In addition, a third correction body 57 that rolls and corrects the corner fold portion which occurs at the sheet trailing edge of the first surface of the sheet S and a fourth correction body 58 that rolls and corrects the corner fold portion which occurs at the sheet trailing edge of the second surface of the sheet S are respectively provided further to the upstream side in the sheet conveyance direction of the respective first rotating brushes 51 and the respective second rotating brushes 52, and further to the downstream side than the first conveyance roller 141.

The first correction body 55 and the second correction body 56, after the corner fold portion which occurs at the leading edge of the sheet S passes through the first correction body 55 and the second correction body 56 toward the conveyance direction, in the middle of conveying the sheet S in the opposite direction to the conveyance direction, a fold portion of the corner fold portion enters and comes into contact with the first correction body 55 and the second correction body 56, the fold portion is rolled according to the movement of the sheet S in the reverse conveyance direction and the corner fold portion is corrected.

The first correction body 55 and the second correction body 56 are, for example, formed by bending or curving a plate, widens a conveyance direction upstream portion 501 with respect to a paper surface of the sheet S which is conveyed on the second conveyance route 10, and narrows a conveyance direction downstream portion 502. When a corner fold portion 201 occurs at the leading edge of the sheet S, when the sheet S is conveyed in the conveyance direction, if the corner fold portion 201 enters the first correction body 55 and the second correction body 56, the corner fold portion 201 is folded up and passes through smoothly. After the corner fold portion 201 passes through the first correction body 55 and the second correction body 56, the folded-up corner fold portion 201 rises (rising height is set to be h1).

If a height of a conveyance direction downstream edge 503 of the first correction body 55 and the second correction body 56 is set to be h2, the corner fold portion 201 whose rising height h1 is higher than the height h2, after passing through the first correction body 55 and the second correction body 56, abuts the conveyance direction downstream edge (hereinafter referred to as a first abutting edge) 503 of the first correction body 55 and the second correction body 56, when the sheet S is conveyed in the opposite direction to the conveyance direction. If the sheet S is conveyed in the opposite direction in this abutting state, while abutting the first abutting edge 503, the corner fold portion 201 is rolled and turned back in the original direction.

The third correction body 57 and the fourth correction body 58 are, for example, formed by bending or curving a plate, narrows a conveyance direction upstream portion 504 with respect to a paper surface of the sheet S which is conveyed on the second conveyance route 10, and widens a conveyance direction downstream portion 505. If the height from the sheet S of a conveyance direction upstream edge (hereinafter referred to as a second abutting edge) 506 of the third correction body 57 and the fourth correction body 58 is set to be h3, when a height h4 of the corner fold portion 203 which occurs at the trailing edge of the sheet S is higher than the height h3, the corner fold portion 203 abuts a second engaging edge 506 when the corner fold portion 203 which occurs at the trailing edge of the sheet S conveyed in the conveyance direction enters the third correction body 57 and the fourth correction body 58. If the sheet S is conveyed in the conveyance direction in the abutting state, while abutting the second abutting edge 506, the corner fold portion 203 is rolled and restored in the original direction.

In addition, brush tips of the first rotating brush 51 and the second rotating brush 52 are provided so as to have a height h5 with respect to the paper surface of the sheet S conveyed on the second conveyance route 10. The first rotating brush 51 and the second rotating brush 52, using the rotating brush, continuously hit and roll the corner fold portions 201, 202 and 203 of the sheet S, and perform a hitting operation to have the original aspect as much as possible. At this time, when the height h1 of the corner fold portion 201 of the leading edge side of the sheet is lower than a height of the first correction body 55 and the second correction body 56, the corner fold portion 201 eludes the first abutting edge 503. In addition, when the height h3 of the corner fold portion 203 of the trailing edge side of the sheet is lower than the height h4 of the third correction body 57 and the fourth correction body 58, the corner fold portion 203 eludes the third correction body 57 and the fourth correction body 58.

Even when such an evading state occurs, so that brush portions of the first rotating brush 51 and the second rotating brush 52 may come into contact with the corner fold portions 201 and 203, a height h5 is set to be lower than the heights h2 and h3.

Figure 7:
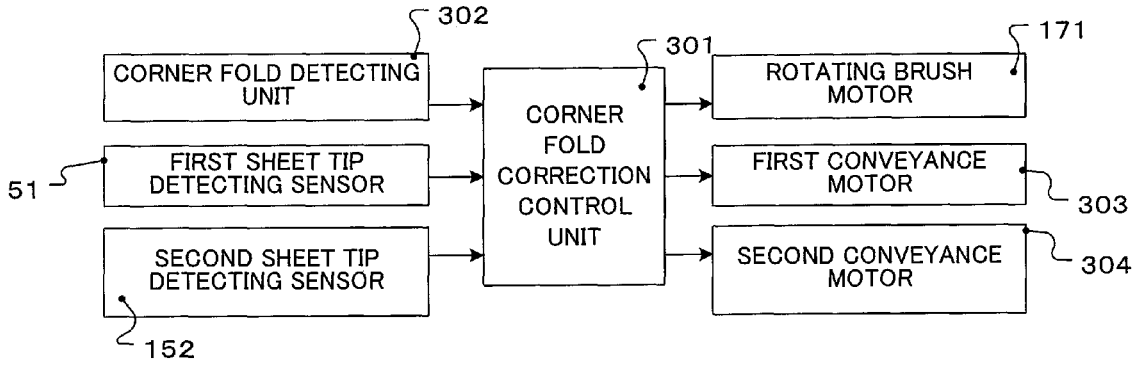
FIG. 7 is a control block diagram illustrating a corner fold correction unit.

FIG. 7 is a block diagram illustrating a control which performs a corner fold correction. Referring to FIG. 7, in the control unit 20 which controls the overall decolorizing device 1 illustrated in FIG. 2, a corner fold correction control unit 301 manages the corner fold correction control and based on the corner fold detecting information from the corner fold detecting unit 302, determines whether or not the corner fold occurs on the sheet S. In one embodiment, the image reading unit 4 also serves as the corner fold detecting unit 302. The corner fold correction control unit 301, using an outline of the sheet S read by the corner fold detecting unit 302, determines whether the corner fold portion is present or absent and whether a location where the corner fold portion occurs is the leading edge or the trailing edge. In addition, the corner fold correction control unit 301, as illustrated in FIG. 4A and FIG. 4B, may obtain a corner fold length L in the conveyance direction of the corner fold portions 201, 202, and 203.

The corner fold correction control unit 301, when a first sheet tip detecting sensor 151 detects that the sheet S reaches the corner fold correction unit 6, drives a first conveyance roller 141 and a second conveyance roller 142, for example, controls to drive a first conveyance motor 303 which is a pulse motor, a second conveyance motor 304 and a rotating brush motor 171, corrects the corner fold portions which occur on the sheet S and conveys the sheet S toward the decolorizing unit 6.

Figure 8:
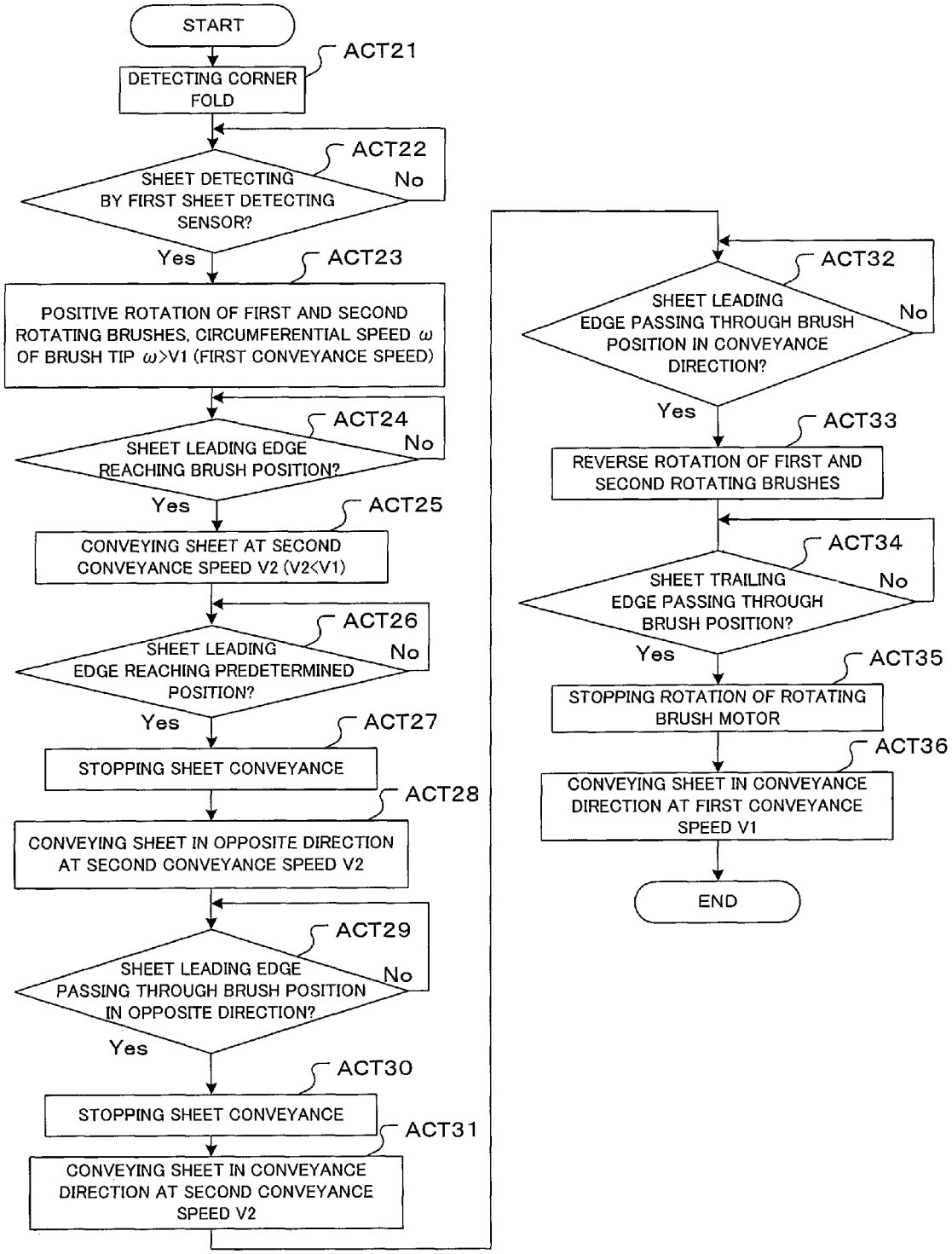
FIG. 8 is a flowchart illustrating a process flow by a corner fold correction control unit in FIG. 7.

Description will be made based on a flowchart where an operation of the corner fold correction control unit 301 illustrated in FIG. 7 is illustrated in FIG. 8 and explanatory views of operations illustrated in FIGS. 9A to 9F. An operation of the corner fold correction control below is described by exemplifying a case where, as illustrated in FIG. 4B, the corner fold portion 201 occurs on the second surface of the leading edge of the sheet S and the corner fold portion 203 occurs on the first surface of the trailing edge. In addition, a normal conveyance speed of the sheet is set to be V1.

First, in ACT 21, the corner fold detecting is performed based on outline information of the sheet which is read by the corner fold detecting unit 302. The corner fold detecting determines whether or not a corner portion of the sheet is absent and the like and determines whether the location where the corner fold occurs is the leading edge or the trailing edge. At that time, in one embodiment, a length L of the corner fold portion is obtained.

Figure 9A:
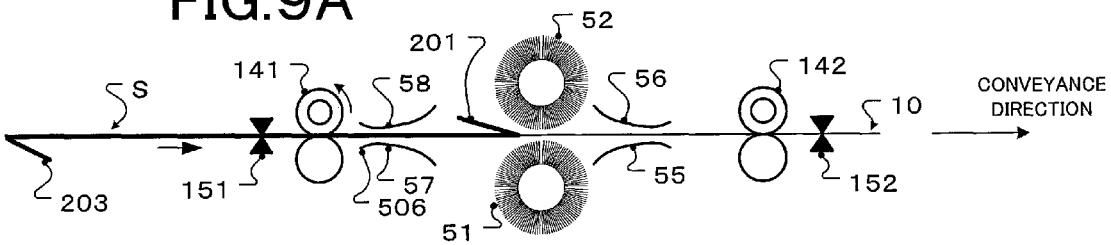
FIG. 9A to FIG. 9F are diagrams illustrating a control state by a corner fold correction control unit.

In ACT 22, the first sheet detecting sensor 151 waits for whether or not the first sheet detecting sensor 151 detects the leading edge of the sheet S and detects the leading edge of the sheet S, and the process proceeds to ACT 23. In a state waiting for the leading edge of the sheet S to pass through the first sheet detecting sensor 151, the first conveyance motor 303 drives to rotate the first conveyance roller 141 in the conveyance direction at the first conveyance speed V1 which is the normal conveyance speed. Then, if the leading edge of the sheet S passes through the first sheet detecting sensor 151, as illustrated in FIG. 9A, the sheet S is conveyed toward the brush position by the first conveyance roller 141 at the normal first conveyance speed V1.

In Act 23, the first and the second rotating brushes 51 and 52 are in positive rotation such that the circumferential speed ω of the brush tip is higher than the normal first conveyance speed V1 (ω>V1), and the process proceeds to ACT 24. Here, the positive rotation of the brush is set to have the same direction as the sheet conveyance direction and the opposite direction is set to be the opposite direction to the conveyance direction.

In Act 24, waiting for whether or not the corner fold portion 201 which occurs at the leading edge of the sheet S reaches the brush position where the first rotating brush 51 and the second rotating brush 52 are arranged, and when reached, the process proceeds to ACT 25.

In Act 25, the speed of the first conveyance motor 303 is reduced to a second conveyance speed V2 (V2<V1) which is lower speed than the normal conveyance speed V1 and the sheet is conveyed in the conveyance direction using the first conveyance roller 141, and the process proceeds to ACT 26. In ACT 25, the corner fold portion 201 which occurs at the leading edge of the sheet S, while being conveyed at the second conveyance speed V2 which is the low speed, is rolled and corrected by the second rotating brush 52 which rotates in the positive direction at the circumferential speed ω. At that time, the sheet is slowly conveyed at the second conveyance speed V2 which is a lower speed than the first conveyance speed V1. Therefore, the rolling by the second rotating brush 52 with respect to the corner fold portion 201 is carefully performed and the correction of the corner fold portion 201 is reliably performed. In addition, damaging to the corner fold portion 201 may be prevented.

In Act 26, waiting for whether or not the leading edge of the sheet S reaches a predetermined position and when reached, the process proceeds to ACT 27 and the conveyance of the sheet is stopped.

In Act 26, after the first and the second rotating brushes 51 and 52 finish the first correcting operation with respect to the corner fold portion 201 which occurs at the leading edge of the sheet S, whether the leading edge of the sheet S reaches a predetermined position is awaited. In one embodiment, the correcting operation of the corner fold portion may be performed by the first correction body 55 and the second correction body 56 or may also be omitted. For this reason, depending on the case when the correcting operation of the corner fold portion is performed by the first correction body 55 and the second correction body 56 and the case when the correcting operation is omitted, the predetermined position where the leading edge of the sheet S reaches may be appropriately determined.

Figure 9B:
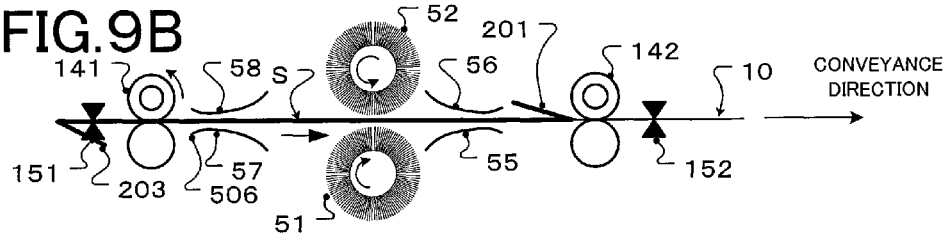

In one embodiment, since the first conveyance motor 303 is a pulse motor, by counting the drive pulses, the leading edge position of the sheet which passes through the first sheet detecting sensor 151 may be detected. Accordingly, as illustrated in FIG. 9B, if the number of drive pulses counted arrives at the position where the corner fold portion 201 of the sheet S passes through the first abutting edge 503 of the first correction body 55 and the second correction body 56, the leading edge of the sheet S is determined to reach a predetermined position. Then, the drive of the first conveyance motor 303 is stopped, the sheet conveyance is momentarily stopped and the process proceeds to ACT 28.

Figure 9C:
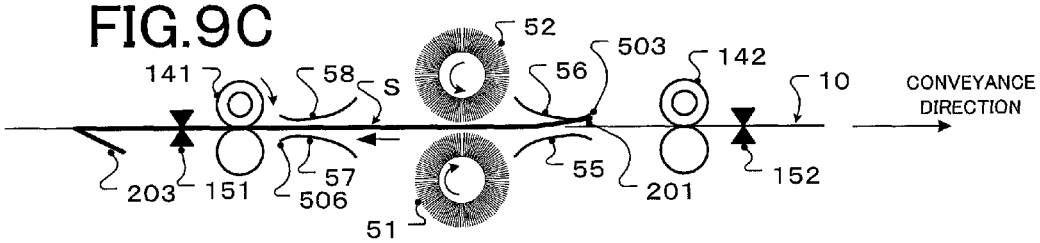

In ACT 28, as illustrated in FIG. 9C, the first conveyance motor 303 is in reverse rotation and the sheet S is conveyed in the opposite direction at the second conveyance speed V2, and the process proceeds to ACT 29. That is, when the sheet S is conveyed in the opposite direction at the second conveyance speed V2 which is a low speed, the corner fold portion 201 which occurs at the leading edge of the sheet S moves toward the first and the second rotating brushes 51 and 52 which rotate in the positive direction. Thus, the corner fold portion is efficiently rolled toward the original direction and the second correcting operation of the corner fold portion 201 is performed.

Figure 9D:
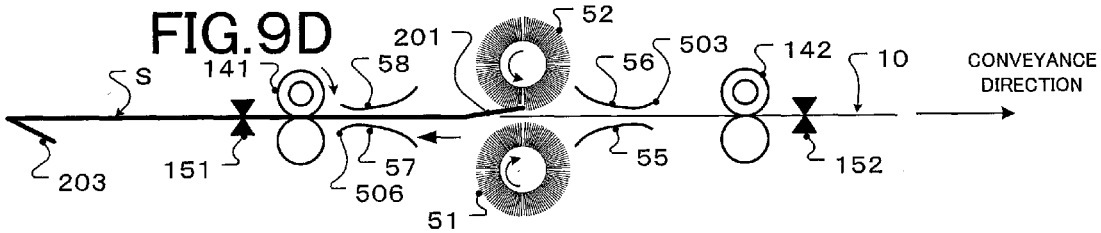

In addition, when performing the correction by the first correction body 51 and the second correction body 52, as illustrated in FIG. 9B to FIG. 9C, the corner fold portion 201 which occurs at the leading edge of the second surface of the sheet S abuts the first abutting edge 503 of the second correction body 56, the folded portion of the corner fold portion 201 is rolled and forced to be restored. Then, the restored corner fold portion 201, as illustrated in FIG. 9D, is pressed while being continuously rolled in the restoring direction by the brush of the second rotating brush 52 and the corner fold correction is further performed.

In ACT 29, it is determined whether or not the leading edge of the sheet S passes through the brush position by the conveyance of the sheet S in the opposite direction. In ACT 27, the distance from the sheet stop position to the brush position is obtainable. For example, by counting the drive pulses described above, it is determined whether or not the leading edge of the sheet S passes through the brush position. When passing through, the process proceeds to ACT 30. Then, the sheet conveyance is stopped and the process proceeds to ACT 31.

Figure 9E:
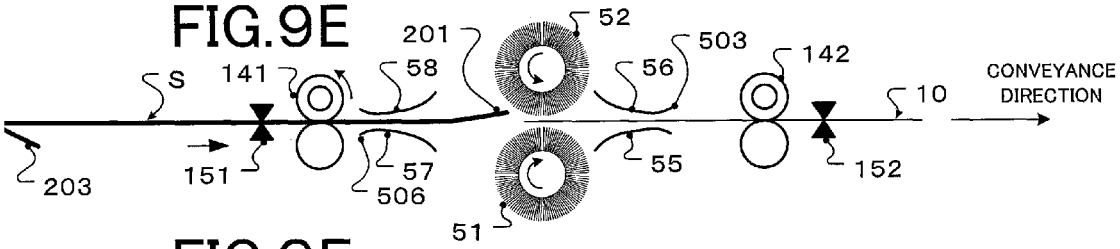

In ACT 31, in order to correct the corner fold portion 203 which occurs at the trailing edge of the first surface of the sheet S, as illustrated in FIG. 9E, the sheet is conveyed in the conveyance direction at the second conveyance speed. In this case, the first conveyance motor 303 is set to be in positive rotation at a reduced speed and the second conveyance motor 304 is also set to be in positive rotation at the same reduced speed. Then, delivery of the sheet S by the second conveyance roller 142 is possible and the process proceeds to ACT 32.

In ACT 31, when the third correction body 57 and the fourth correction body 58 are arranged, the corner fold portion 203 which occurs at the trailing edge of the first surface of the sheet S abuts the second abutting edge 506 of the third correction body 57 and the folded portion of the corner fold portion is rolled and restored in the original direction.

In ACT 32, it is determined whether or not the leading edge of the sheet S passes through the brush position in the conveyance direction. Determination may also be made by counting the above-described drive pulses. If the leading edge of the sheet S passes through the brush position, the process proceeds to ACT 33.

Figure 9F:
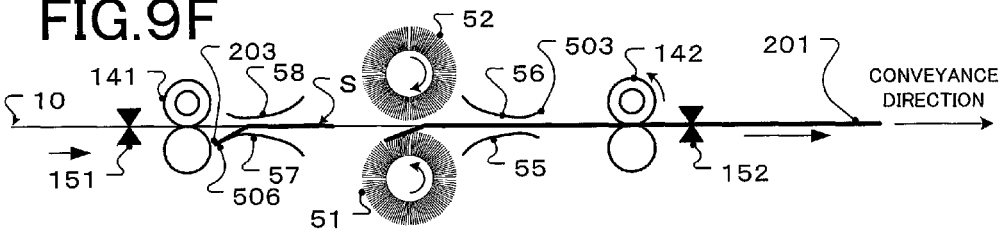

In ACT 33, the first rotating brush 51 and the second rotating brush 52 are set to be rotated in the opposite direction. At that time, the circumferential speed of the brush tip may also be the circumferential speed ω in positive rotation. However, it is preferable to set the circumferential speed to an extent without damaging the sheet and the circumferential speed which enables the folded portion of the corner fold portion to be sufficiently rolled. In ACT 32, as illustrated in FIG. 9E, until the corner fold portion 201 of the leading edge of the sheet passes through the brush position again in the sheet conveyance direction, the first rotating brush 51 and the second rotating brush 52 are rotated in positive direction such that the corner fold portion 201 which finishes the corner fold correction may not be folded when passing through the brush position. Then, if the corner fold portion 201 which finishes the corner fold correction passes through the brush position in the sheet conveyance direction, as illustrated in FIG. 9F, the first rotating brush 51 and the second rotating brush 52 are rotated in reverse direction. Through a continuous rolling operation on the corner fold portion 203 of the trailing edge of the sheet, the corner fold correction is performed. Then, the process proceeds to ACT 34.

In ACT 34, it is determined whether or not the trailing edge of the sheet S passes through the brush position and when passing through, the process proceeds to ACT 35. The rotation of the rotating brush motor 171 is stopped and the rotations of the first rotating brush 51 and the second rotating brush 52 are stopped. Then, the process proceeds to ACT 36.

In ACT 36, the speeds of the first conveyance motor 301 and the second conveyance motor 302 are switched to the normal conveyance speed, the sheet S is conveyed toward the decolorizing unit 6 in the conveyance direction at the first conveyance speed and the operation is completed.

In one embodiment, at the correction area set between the first conveyance roller 141 and the second conveyance roller 142, the first correction body to the fourth correction body are arranged and the sheet S which is conveyed toward the conveyance direction is momentarily stopped. Then, after the sheet S is reversely conveyed in the opposite direction to the conveyance direction, the sheet S is conveyed in the conveyance direction again. However, it may also be preferable that, without arranging the first correction body to the fourth correction body, the corner fold portion which occurs at the sheet S is corrected only by the first rotating brush 51 and the second rotating brush 52.

In addition, the sheet S which finishes the corner fold correction is conveyed to the decolorizing unit 6, and the first surface and the second surface are heated and achromatized. The correction of the corner fold portion may be good enough if it is flat to have the same level as the paper surface of the sheet S. However, as illustrated in FIG. 9E and FIG. 9F, it may also be preferable to be slightly bent with respect to the paper surface of the sheet S. Even though the corner fold portion is slightly present like this, if passing through a nipping unit of the decolorizing unit 6, the corner fold portion is eliminated. That is, when the sheet S which finishes the corner fold correction passes through the nipping unit of a first heating unit 63 and a second heating unit 64 of the decolorizing unit 6, the corner fold portions 201 and 203 which finish the corner fold correction and are still slightly bent are heated and pressurized to eliminate creases. Thus, the corner fold portions 201 and 203 return to have original corner portion and the corner portion of the sheet S is completely eliminated.

In addition, when the heights h1 and h4 of the corner fold portion are too low, the correction by the first to the fourth correction bodies 55 to 58, and the first rotating brush 51 and the second rotating brush 52 may not be performed. In this case, the sheet is conveyed to the reading unit 4 through the merging unit 91 on the first conveyance route 9 again without the corner fold being corrected.

The control unit 20 of the decolorizing device illustrated in FIG. 2, determines whether or not the corner fold correction is suitable (whether or not the sheet is reusable) based on the reading information such as the outline of the sheet S which is read by the reading unit 4.

In determining that the corner fold correction is suitable, a case where four corner portions of the sheet S are all present may be exemplified. In determining that the corner fold correction is negative, a case where any one of the four corner portions of the sheet S is absent may be exemplified. Here, in determining whether or not the corner fold correction is suitable, an image stored at the storage unit 21 may be used and the section where the corner fold portion is present may be determined. In addition, when the four corner portions of the sheet S which are stored at the storage unit 21 are all present, it is not required to determine whether or not the corner fold correction is suitable.

The sheet S for which it is determined that the corner fold correction is negative, even though determined to be reusable in ACT 8 in FIG. 3, is determined to be non-reusable as a final result and loaded on the second loading tray. The sheet S which is determined to be reusable in ACT 8 in FIG. 3 and for which it is determined that the corner fold correction is suitable is determined to be reusable as the final result and loaded to the first loading tray.

In one embodiment, using the first correction body 55 and the second correction body 56, after correcting the corner fold portion 201 which occurs at the leading edge of the sheet S, while reversely conveying to the brush position, the first rotating brush 51 and the second rotating brush 52 secondarily perform the correction. However, without using the first correction body 55 and the second correction body 56, the first rotating brush 51 and the second rotating brush 52 may also perform the correction.

In addition, in detecting the corner fold, when the corner fold portion occurs at only the trailing edge of the sheet S, ACTS 24, 26, 27, 28, 29, 30 and 31 in FIG. 8 may be omitted in the process.

In contrast, in detecting the corner fold, when the corner fold portion occurs at only the leading edge of the sheet S and the corner fold portion is absent at the trailing edge, when the trailing edge of the sheet passes through the brush position, the first rotating brush 51 and the second rotating brush 52 are not rotated in the opposite direction to the sheet conveyance direction.

Furthermore, when the corner fold portion does not occur on the sheet S, without performing the corner fold correction, the first conveyance motor 303 and the second conveyance motor 304 are driven toward the conveyance direction at the first conveyance speed V1 and the sheet S is conveyed toward the decolorizing unit 6.

In addition, in detecting the corner fold, the drive control is made in response to the corner fold length L, but the corner fold length may also be set to be a predetermined value.

Second Embodiment

Figure 10:
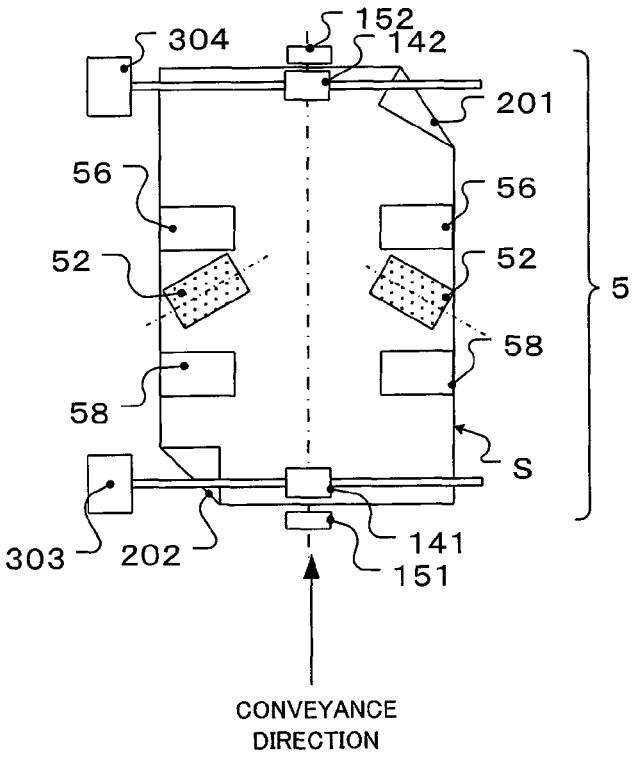
FIG. 10 is a top view of a corner fold correction unit illustrating a second embodiment.

FIG. 10 is a top view of a corner fold correction unit illustrating a second embodiment.

In one embodiment, as illustrated in FIG. 4A and FIG. 4B, a turned-back edge 204 of the corner fold portion 201, 202 and 203 is inclined with respect to the width direction of the sheet. Accordingly, the drive shafts 53 and 54 of the first rotating brush 51 and the second rotating brush 52 are set to be inclined in keeping with the edge 204. That is, the lateral surfaces of the first rotating brush 51 and the second rotating brush 52 come into contact with the inclined edge 204 of the corner fold portion at the same time. Therefore, the corner fold correction may be efficiently performed by rolling operation using the rotating brushes.

Third Embodiment

Figure 11:
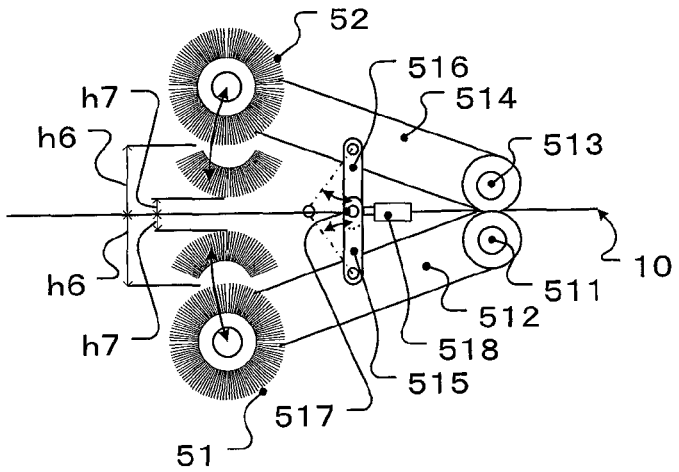
FIG. 11 is a front view of a first rotating brush and a second rotating brush of a corner fold correction unit illustrating a third embodiment.

FIG. 11 is a front view of a corner fold correction unit illustrating a third embodiment.

In one embodiment with respect to a conveyance surface C of the sheet S, a height h of the first rotating brush 51 and the second rotating brush 52 may be changed. Thus, until ACT 26 illustrated in FIG. 8, the rotating brushes are made to stand by at a high position h6 and, if the sheet S starts to be conveyed in the opposite direction, are made to move from the height h6 toward a height h7 with which the corner fold portion comes into contact. Accordingly, when the sheet S passes through the brush position before the corner fold correction, the brush portion does not touch the corner fold portion.

In order to move the first rotating brush 51 and the second rotating brush 52 between the heights h6 and h7, for example, the first rotating brush 51 is rotatably attached to a first arm 512 capable of rotating around a spindle 511 and similarly, the second rotating brush 52 is rotatably attached to a second arm 514 capable of rotating around a spindle 513. To the first arm 512 and the second arm 514, a first link member 515 and a second link member 516 are connected and respective tips of the first link member 515 and the second link member 516 are connected to each other by a pin 517. Accordingly, by moving the pin 517 back and forth in the conveyance direction, the first arm 512 and the second arm 514 may be moved, and the first rotating brush 51 and the second rotating brush 52 may be moved between the heights h7 and h6. The straight movement of the pin 517, for example, is performed by an actuator 518. The movement of the first rotating brush 51 and the second rotating brush 52 is not limited to a configuration where such a link mechanism is used. In addition, the first rotating brush 51 and the second rotating brush 52 may be moved up and down.

For the first rotating brush 51 and the second rotating brush 52, a configuration may be used for example, in which dedicated motors are provided for each of the first rotating brush 51 and the second rotating brush 52, and the respective motors transmit rotation drive power. In addition, using a drive mechanism which has one rotating brush motor and a power transmission mechanism which outputs drive power of the motor to two rotating shafts (the rotating directions are opposite to each other), the drive power of the respective rotating shafts may be transmitted to the first rotating brush 51 and the second rotating brush 52.

In each embodiment described above, thermal decolorizing is exemplified, without limitation.

One embodiment, without departing from the spirit or gist thereof, may be variously modified. Therefore, the embodiments described above are considered as only an example in all respects and are not construed to a limited extent. The scope of the present disclosure is shown by claims and is not bound by the specification in any way. In addition, within the equal scope of the claims, various modifications, improvements, substitutions and reformations may be resorted to within the scope of the present disclosure.

What is claimed is:

1. An erasing device comprising:

a conveyance unit that conveys a sheet along a conveyance path;

a pair of rotating brushes provided on opposite sides of the conveyance path and opposed to each other and positioned in a width direction perpendicular to a conveying direction of the sheet conveyed by the conveyance unit, the rotating brushes being configured to rotate so that a brush tip portion closest to the conveyance path has a tangential velocity in the same direction as the conveying direction and the tangential velocity of the brush tip portion being greater than a conveyance speed of the sheet so that a corner fold portion which occurs on the sheet is contacted and corrected by the rotating brush tip portion;

a pair of correction guides provided on opposite sides of the conveyance path and opposed to each other and on the upstream side in the conveying direction from the rotating brushes, the correction guides being shaped so that first ends of the correction guides on the upstream side in the conveying direction define a first width of the conveyance path between the first ends, and second ends of the correction guides on the downstream side in the conveying direction define a second width of the conveyance path between the second ends, the second width being larger than the first width; and an erasing unit provided downstream in the sheet conveyance direction than the rotating brush, the erasing unit erasing an image which is formed on the sheet.

2. The device according to claim 1, wherein the conveyance unit first conveys the sheet at a first conveyance speed that is a normal conveyance speed and then, when correcting a corner fold by the rotating brush with respect to the corner fold portion of the sheet, conveys the sheet at a second conveyance speed lower than the first conveyance speed.

3. The device according to claim 2 further comprising:

a control unit that switches a rotating direction of the rotating brushes so that the tangential velocity of the brush tip portion closest to the conveyance path is in a direction opposite to the conveying direction, before a trailing edge of the conveyed sheet passes through a position of the rotating brush.

4. The device according to claim 3, wherein the erasing unit heats and pressurizes the sheet on which an image is formed using a color material which is decolored at a predetermined decolorizing temperature.

5. The device according to claim 1, further comprising:

a control unit that switches a rotating direction of the rotating brushes so that the tangential velocity of the brush tip portion closest to the conveyance path is in a direction opposite to the conveying direction, before a trailing edge of the conveyed sheet passes through a position of the rotating brushes.

6. The device according to claim 1, further comprising:

a corner fold detecting unit that detects the corner fold portion of the sheet; and a control unit configured to control rotation of the rotating brushes, wherein, when the corner fold portion is detected at the trailing edge portion of the sheet, the control unit switches a rotating direction of the rotating brushes so that the tangential velocity of the brush tip portion closest to the conveyance path is in a direction opposite to the conveying direction before a trailing edge of the conveyed sheet passes through a position of the rotating brushes, and, when no corner fold portion is detected at the trailing edge portion of the sheet, the control unit does not rotate the rotating brush in the opposite direction.

7. The device according to claim 1, wherein the conveyance unit, after conveying the sheet until a leading edge of the sheet reaches a predetermined position on the conveyance path at the downstream side in the conveyance direction from the position of a pair of the rotating brushes, conveys the sheet in a direction opposite to the conveying direction until the leading edge of the sheet reaches the upstream side of the rotating brushes in the conveying direction and then conveys the sheet in the conveying direction again.

8. The device according to claim 7, further comprising:

a control unit that switches the rotating direction of the rotating brushes so that the tangential velocity of the brush tip portion closest to the conveyance path is in a direction opposite to the conveying direction before the trailing edge of the sheet conveyed in the conveying direction passes through the position of a pair of the rotating brushes.

9. The device according to claim 8, comprising:

a second pair of correction guides provided on opposite sides of the conveyance path and opposed to each other and on the downstream side in the conveying direction from the rotating brushes, the second pair of correction guides being shaped to abut the corner fold portion which occurs at the leading edge portion of the sheet as the sheet is conveyed in the opposite direction to the conveying direction and to correct the corner fold.

* * * * *